US005875568A

United States Patent [19]

Lennihan, Jr.

[11] Patent Number: 5,875,568

[45] **Date of Patent: *Mar. 2, 1999**

[54] RUNNING SHOE

[76] Inventor: Richard Lennihan, Jr., 3317 Heritage Dr., Wilmington, Del. 19808

[ * ] Notice: This patent issued on a continued prosecution application filed under 37 CFR 1.53(d), and is subject to the twenty year patent term provisions of 35 U.S.C. 154(a)(2).

[21] Appl. No.: 719,685

[22] Filed: Sep. 26, 1996

[51] Int. Cl.[6] ..... A43B 13/18; A43B 21/26; A43B 21/32; A43B 13/22

[52] U.S. Cl. ..... 36/28; 36/32 R; 36/114; 36/59 C; 36/37; 36/35 R; 36/25 R

[58] Field of Search ..... 36/25 R, 28, 31, 36/35 R, 37, 59 R, 59 C, 30 R, 32 R, 114, 132

[56] References Cited

U.S. PATENT DOCUMENTS

| | | | |
|---|---|---|---|
| 532,429 | 1/1895 | Rogers | 36/28 |
| 2,124,986 | 7/1938 | Pipes | 36/35 R |
| 2,162,912 | 6/1939 | Craver | 36/59 C |
| 4,179,826 | 12/1979 | Davidson . | |
| 4,262,435 | 4/1981 | Block et al. . | |
| 4,314,413 | 2/1982 | Dassler . | |
| 4,316,335 | 2/1982 | Giese et al. . | |
| 4,348,821 | 9/1982 | Daswick . | |
| 4,364,188 | 12/1982 | Turner et al. . | |
| 4,364,190 | 12/1982 | Yonkers . | |
| 4,557,059 | 12/1985 | Misevich et al. . | |
| 4,631,842 | 12/1986 | Koskela | 36/59 R |
| 4,741,114 | 5/1988 | Stubblefield . | |
| 4,956,927 | 9/1990 | Misevich et al. | 36/25 R |
| 4,970,807 | 11/1990 | Anderié et al. | 36/35 R |
| 5,086,574 | 2/1992 | Bacchiocci | 36/35 R |
| 5,092,060 | 3/1992 | Frachey et al. | 36/28 |
| 5,282,288 | 2/1994 | Henson | 36/28 |
| 5,369,896 | 12/1994 | Frachey et al. | 36/28 |
| 5,390,430 | 2/1995 | Fitchmun et al. | 36/25 R |
| 5,537,762 | 7/1996 | Walters . | |

*Primary Examiner*—Paul T. Sewell
*Assistant Examiner*—Anthony Stashick
*Attorney, Agent, or Firm*—Connolly & Hutz

[57] ABSTRACT

An athletic shoe for a human foot containing an elongated sole piece having a front, middle and rear section and having a ground engaging bottom surface and an upper surface in which the wearer's foot is received and, an upper piece secured to said sole piece, said upper piece providing an enclosed embracing foot enclosure having a counter section at the rear of the foot, a mid-body section, and a toe box section at the front, wherein said sole piece has a curved sole at the rear section of the sole to permit the user's foot to be tilted forward to enhance the power of the push when the user's foot makes contact with ground when the user strikes at the user's heel. In addition, the shoe can have an improved tread design and a removable and replaceable shock absorbing insert. The shoe preferably employs the principle of energy conversion.

18 Claims, 2 Drawing Sheets

RUNNING SHOE

BACKGROUND OF THE INVENTION

This invention describes an imaginative new shoe design based on the principle of energy conversion. The inventive shoe will make running smoother, easier, more efficient, quicker, and simultaneously will reduce injuries arising from impact forces.

All runners fit in two simple categories, those who land on their heels and those who land on their toes.

Heel runners: These, known also as "heel strikers", land on the back portion of their heel, roll forward on the outer side of the foot, and push off from the toe-forefoot area. The "striking" occurs in a relatively small region at the rear and outside of the heel. The impact of force or pressure of landing is calculated in pounds per square inch. That is, the weight of the runner multiplied by the impact area in square inches (small; say one half by one inch). The resulting impact pressure or force is large, often awesome. Since the descent of the foot on hitting the ground stops abruptly, in fact almost instantaneously, the law of "equal opposite forces" dictates that an equal pressure or force is transmitted in the opposite direction, back up the leg from foot to ankle to knee to hip. Taken over time, this jolt in distance runners (30 miles or more a week) causes predictable wear and tear problems involving foot, ankle, knee, hip and even back. This is the source of most injuries in distance runners. In addition, most "heel strikers" land with center of gravity slightly behind the point of impact, hence some of the reactive force up the leg actually pushes them backward. The runner locks the knee and "pogo-sticks" over the foot before rolling forward to the push-off position. This is inefficient, wasteful of energy, and tiring while causing a small though real slowing of the runner's forward progress.

Toe Runners: The other, smaller group of runners land on their toes or actually their forefoot areas. The point of impact is more apt to be under or modestly behind their center of gravity. The knee is slightly bent and absorbs some reactive energy. This style propels the runner forward, is more efficient, less tiring, and less prone to injuries. This group tends to be the sprinters and the elite distance runners.

All shoes are basically the same. Tops to cover the foot and keep the bottoms in place. Bottoms to protect the sole and to provide cushioning to absorb impact pressures.

Over recent years, shoe manufacturers have developed a variety of materials to reduce impact pressures through principles of compression and dispersion to absorb energy. Thus, modifications in design and composition of the heels (sponges, inserts, treads, air, and gels) and forefoot (sponges, inserts, and treads). All shoes employ the same principles with only a variation in theme. Thus the following:

U.S. Pat. No. 4,616,335 describes an athletic shoe structure including shock absorbing portions in the heel and foot areas of the sole of the shoe as well as particular placement of flexible nubs on the soft area.

U.S. Pat. No. 4,348,821 is directed towards the development of a shoe sole construction that will be mechanically effective for walking, running or jogging.

U.S. Pat. No. 4,262,435 is directed to an improved athletic shoe and with the sole piece as a wedge to facilitate supporting the runner's foot when contacting the ground.

Today, there is a need to make the shoe better by incorporating the concept of "conversion" in the design of the shoe. No shoe to date employs the principle of energy conversion.

SUMMARY OF DESIGN CONCEPT

This invention focuses on energy conversion as a new concept in running shoes.

Secondarily it describes a new configuration for the treads and a new, replaceable shock absorber unit. Both are a direct consequence of the basic innovated shoe design.

SUMMARY OF THE INVENTION

An object of this invention is the design and development of the shoe with a rounded heel strike area and gently curved bottom. The runner would roll smoothly forward converting energy in a useful forward motion while reducing the reactive impact force that normally travels back up the leg. The runner would thus be more efficient with simultaneous decrease in injuries due to impact pressures.

Another object of this invention is the design and development of modified treads. Since most heel strikers slide or shuffle rather than plant their foot in making first contact to the ground, the treads on the heel and back portion of the shoe should embrace or utilize this fact by making the treads a series of longitudinal grooves much like the grooving of an automobile or airplane tire. In contrast, the forefoot treads should be horizontal grooves or ridges to facilitate the force or gripping of the ground in the push-off of running.

Another object of this invention is the design development of the replaceable shock absorber unit to nestle within the rounded, thickened heel.

Taking these three components separately and together, this invention will create a shoe to enhance ease, comfort, smoothness, and efficiency while allowing a greater longevity of the product and reducing running injuries.

This invention is directed to a shoe for a human foot comprising a sole piece and an upper piece. The sole piece consists of a front, middle, and rear section with a ground engaging bottom surface. Further, the sole piece will be curved, particularly at the rear permitting the users foot to tilt slightly forward to enhance power during the push-off phase of the stride. The upper piece, secured to the bottom, creates an enclosure to embrace the foot. The upper piece too has a front or toe box section, a middle and a rear section.

DESCRIPTION OF THE PREFERRED EMBODIMENTS

Figure 1:
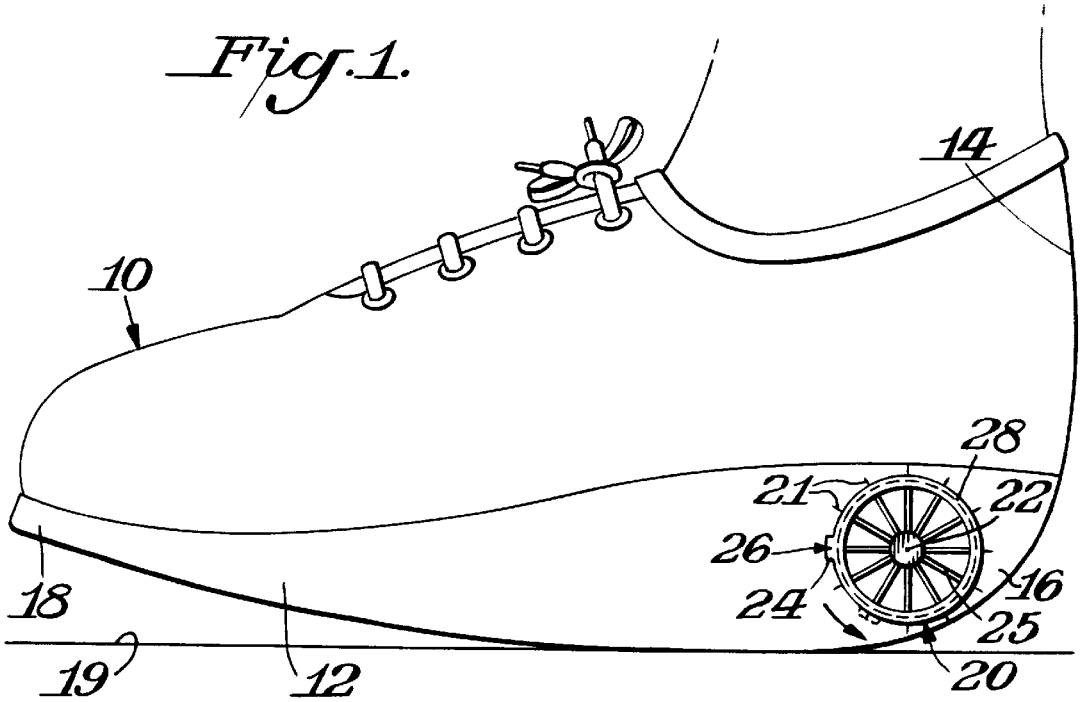
FIG. 1 shows a side elevational view of an embodiment according to this invention.

FIG. 1 shows a side elevational view of a running shoe according to this invention. The running shoe 10 has a sole 12 which would make contact with the ground surface 19. The running shoe 10 has an upper portion 14 that is connected to the sole 12. The sole 12 would have a rounded heel 16 at the rear and a toe 18 at the front of the sole 12. The rounded heel 16 would enable a heel-striker to hit on the heel 16 and roll forward on the surface 19 and be able to push-off at the toe 18.

Figure 2:
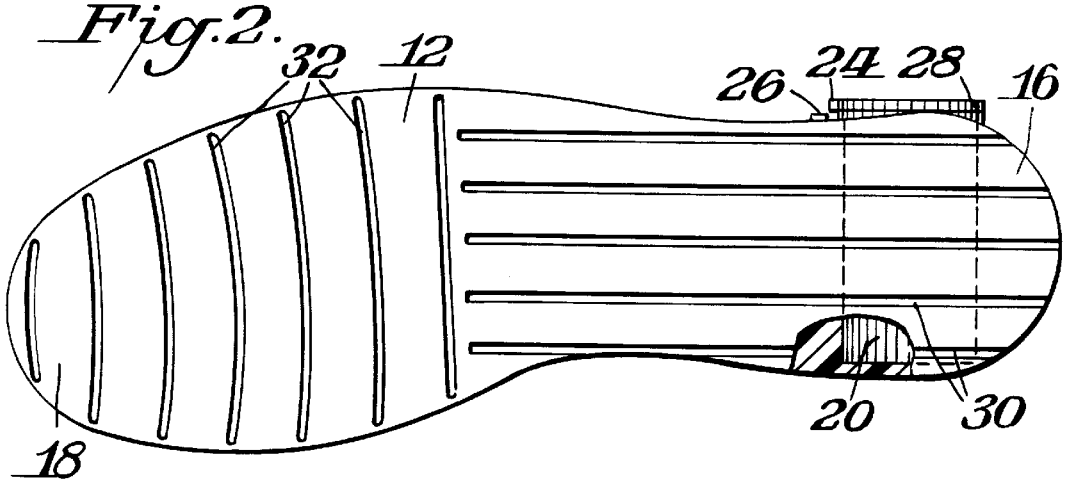
FIG. 2 shows a bottom plan view of the running shoe shown in FIG. 1, showing a sole tread design according to this invention.

Also it is possible to have a shock-absorbing insert 20 that can be located in the rear of the sole 12 or above the sole 12 in the rear of the running shoe 10. The insert 20 can be partially through (as shown in FIGS. 1 and 2) or go completely through (being exposed transversely on each side of the running shoe 10). The insert's 20 purpose is to provide a compression device for the running shoe 10. There are a number of types of possible inserts 20 that could be used. The insert 20 can have a core 22 in the center. The core 22 can be made of an shock-absorbing material such as, but not limited to a rubber, a rigid foam or a plastic material. The core 22 can be the length of the entire insert 20. Connected to the core 22 can be radial ribs 25. The radial ribs 25 can be made of the same or different material as the core 22. Each radial rib 25 can have one end connected to a casing 28 and can have the other end connected to the core 22.

It is also possible to have a tab 24 connected to the insert 20. An index arrow 26 can be located on the sole 12. Having the tab 24 and the index arrow 26 would make it easier to determine how much the insert 20 is rotated. The user can rotate the insert 20 in increments of about 15° to about 180°, preferably from about 15° to about 30°, every time the user laces up the shoes. The index arrow 26 will help the user to measure how much the user has rotated the insert 20. For convenience, the running shoe 10 can have marks 21 on the sole 12 or above the sole in the rear of the running shoe 10 such that the marks 21 are located around the outer circumference of the insert 20.

FIG. 2 shows the bottom plan view of the running shoe 10 shown in FIG. 1, showing a sole and tread design. The rear tread 30 would be longitudinally to accommodate the shuffler (a runner who shuffles his feet on the ground instead of picking his feet off the ground) and to maximize the energy of the shoe when it hits the ground surface 19 instead of resisting the shoe 10 when the shoe 10 rolls on the ground surface 19. In sharp contrast, the forefoot treads 32 should be transverse allowing the treads 32 to grip the road surface at the moment of push-off. The forefoot treads 32 would be perpendicular to the longitudinal rear threads 30.

Figure 3:
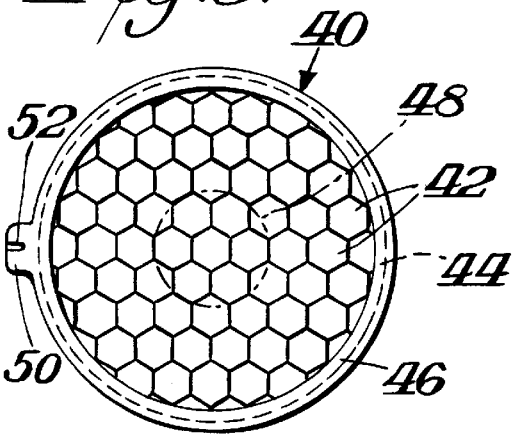
FIG. 3 shows a side elevational view of an alternate compression insert design according to this invention.

FIG. 3 shows a side elevational view of an alternative compression tube insert design. The insert 40 can be removable and replaceable. The insert 40 can be made up of longitudinal hexagonal cells 42. The cells 42 would connect and fit inside a casing 44. There could be an outer flange 46 covering the casing 44. Optionally, there could be a core 48 as is shown in FIG. 3 in phantom. The hexagonal cells 42 can be connected on top of the core 48 and inside the casing 44. If no core 48 is present, then the hexagonal cells 42 can fit one next to the other inside the casing 44. There could be a tab 50 connected to the outer flange 46. Additionally, there could be an index marker 52 located on the rotatable tab 50 to allow easy identification of how much the insert 40 has been rotated on the shoe 10.

Figure 4:
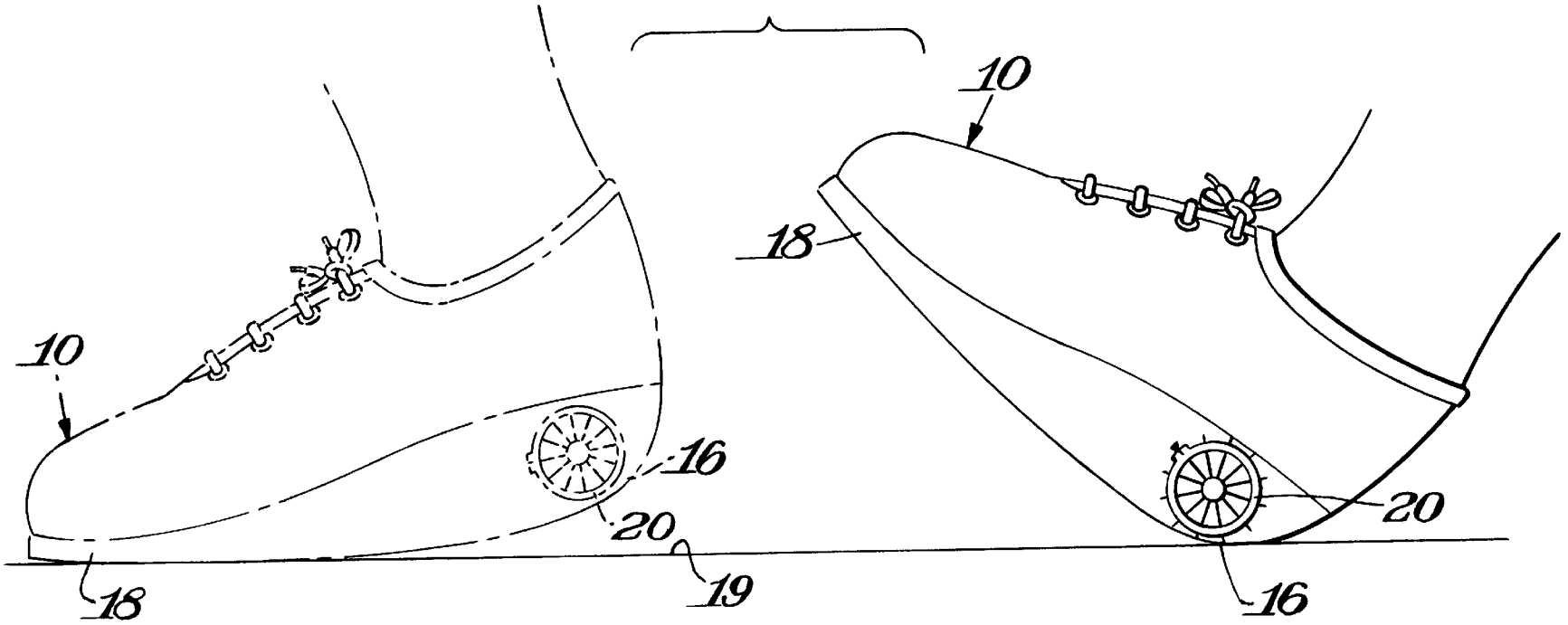
FIG. 4 shows a schematic side elevational view showing the running shoe contacting the ground surface with the user's leg as a point of reference.

FIG. 4 shows the schematic side elevational view showing the running shoe contacting the ground surface with the user's leg as a point of reference. When the runner strikes the ground surface 19, the heel 16 makes contact with the ground surface 19, with the foot simultaneously rolling forward to the toe 18. The runner then pushes off the toe 18 having a slightly bent knee. Since the knee is slightly bent, the impact energy is thus converted to forward energy or forward thrust, propelling the runner along his way. The design of the shoes, in particular, having an enlarged rounded or curved raised heel portion causes this phenomenon to occur. When the shoe 10 is resting on a level surface, the upper inner sole where the foot would rest, would not be completely parallel to the ground surface like all running shoes but would actually have the heel portion slightly higher in elevation than the toe portion of said inner sole.

Summary of the advantages of the shoe are as follows:

(1) The rounded heel strike area

As the heel makes contact with the ground surface, the foot instantaneously rolls forward. The impact energy is thus converted to forward energy or forward thrust, propelling the runner along his way. This is an energy saving device that simultaneously reduces the jolt directed back up the leg under the law of equal and opposite forces. This configuration would lessen discomforts and injuries while making the runner more efficient and faster.

(2) The push-off

In both walking and running a person normally plants the heel, rolls forward on the outer portion of the foot, then pushes off with toes and fore foot. The push-off provides the drive or energy to propel the body forward. The new shoe with rounded and raised heel flows easily into gently sloping mid-foot and fore-foot. Inside the shoe, the foot itself is tilted ever so slightly forward enhancing the power of push off (similar to the sprinter running on his toes).

(3) The Treads

Most people are heel-strikers and shuffle making contact with the ground. The treads should be designed on the heel area to utilize this fact. The tread should be grooved longitudinally to accommodate the shuffler. They should not be configured into miscellaneous swoops and swirls which is so common in running shoes today. The treads should look like the major grooving in automobile and airplane tires. This visual analogy gains further strength in knowing the rounded heel is specifically designed to roll the foot forward. In sharp contrast, the fore foot treads should be transverse allowing the treads to grip the ground at the moment of push off.

(4) Cylindrical Shock Absorber

Running shoes wear out, treads erode, heels loose cushioning, and the fore foot goes flat. To prolong the life of the shoe, it is possible to have an insert replacement shock absorber within the heel. The insert can extend from side to side for the full width of the heel area. The insert can be constructed to allow rotation. The runner could rotate the insert about 15–20 degrees every time the runner puts on the shoes. This would eliminate repeated pounding on exactly the same spot; thereby, extending the life of the cushioning. The cushioning can also be constructed as removable. The runner can remove the insert, reverse it and reinsert it. When the cushioning or insert is worn out the runner would remove it and can than replace it with a fresh unit.

More cushioning could be added to the fore foot because of the greater thickness of the shoe. With this combination of techniques to moderate impact pressures (conversion, compression/absorption, and dispersion) the bottom surface could relinquish any responsibility as a shock adsorbate. Just make it thin and worldly tough such as using KEVLAR a trademarked product which is a high-strength aramid.

This inventive design of the shoe, deploys a conversion of energy, a new tread pattern, and a cylindrical cushioning unit that could be both rotated and replaced. Variations with these three concepts is endless. The rounded profile of the shoe could well vary to the height and stride length of the runner, with flat versus hilly country, with short versus long run/races, etc. Different tread configurations would surely emerge. It would also be possible for the insert to be a configuration of hexagonal shaped cells made up of compressible material such as the honeycombed shape constructed by bees.

The shoes are designed to redirect impact forces that slow progress and cause injuries. The principles involved would also be applicable to walking. Since the new shoe conserves energy it theoretically should be faster for longer races than sprints.

The inventive running shoe is helpful in reducing the assault of impact pressures on the body, by the conversion and dissipation of energy.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described.

I claim:

1. An athletic shoe for a human foot that has a sole piece having a front section where a user's fore foot would be located, a middle section and a rear section where the user's heel would be located, and having a ground engaging bottom surface and an upper surface in which the wearer's foot is received, consists essentially of a transverse tread design at the front section of said sole piece and a longitudinal tread design at the rear section of said sole piece and said longitudinal tread lies parallel to the length of said sole piece and said transverse tread lies across to the width of said sole piece.

2. The athletic shoe as claimed in claim 1, wherein said bottom surface of said sole piece is rounded and elevated at the rear section of the sole and when said shoe is resting on a level surface, the upper surface of the sole where the foot would rest, would not be parallel to the ground surface and would have the rear section slightly higher in elevation than the front section of said sole and said bottom surface of said sole piece from said rear section to said middle section has a single low point located on a smooth continuous surface whereby when said sole at said rear section makes contact with a ground surface, said sole rolls to said middle section smoothly thereby reducing the reactive impact force.

3. The athletic shoe as claimed in claim 1, wherein said bottom surface of said sole is made from a high-strength aramid.

4. The athletic shoe as claimed in claim 1, wherein a hole is located completely through said upper sole in the rear section above the bottom surface and below the top surface of said sole piece, said hole would go completely across the athletic shoe, from inside of said sole to the outside of said sole.

5. A method of exercising comprising a user wearing a pair of shoes as claimed in claim 1, and the said user lands on the rear section of said sole of said shoe, and pushes off the ground surface with said front section of said sole.

6. The athletic shoe as claimed in claim 1, including a removable shock absorbing insert located in the upper end of said sole in the rear section, thereby supplying more cushioning to the rear of said shoe and said shock absorber insert being about the same length as the width of said upper sole in the rear section of said sole.

7. The athletic shoe as claimed in claim 6, wherein said bottom surface of said sole piece is rounded and elevated at the rear section of the sole and when said shoe is resting on a level surface, the upper surface of the sole where the foot would rest, would not be parallel to the ground surface and would have the rear section slightly higher in elevation than the front section of said sole and said bottom surface of said sole piece from said rear section to said middle section has a single low point located on a smooth continuous surface whereby when said sole at said rear section makes contact with a ground surface. said sole rolls to said middle section smoothly thereby reducing the reactive impact force.

8. The athletic shoe as claimed in claim 1, wherein said sole has an upper end and lower end, said lower end makes contact with the ground and the shoe further includes a shock absorber insert located in the upper of the sole in the rear section, thereby supplying more cushioning to the rear of said shoe, and said shock absorber insert being about the same length as the width of said upper end of said sole in the rear section of said sole.

9. A method of prolonging the life of a running shoe comprising a user wearing a pair of shoes as claimed in claim 8, and said user adjusting the shock absorber insert by turning said shock absorber insert prior to the user exercising and said user then begins to run, thereby eliminating the repeated pounding on exactly the same spot of said insert.

10. The athletic shoe as claimed in claim 8, further comprising selectively alienable indicia on the insert and on the sole around said insert.

11. The athletic shoe as claimed in claim 8, wherein said shock absorber is rotatable.

12. The athletic shoe as claimed in claim 11, wherein said shock absorber insert is a cylindrical shape and said insert located in the upper end of said sole in the rear section above the bottom surface of said sole piece, thereby located completely inside said sole and not making contact with said ground surface.

13. The athletic shoe as claimed in claim 11, wherein said shock absorber is removable.

14. An athletic shoe for a human foot that has a sole piece having a front section where a users fore foot would be located, a middle section and a rear section where the user's heel would be located, and having a ground engaging bottom surface and an upper surface in which the wearer's foot is received, wherein the improvement comprises a shock absorber insert located in the upper sole piece in the rear section thereby supplying more cushioning to the rear of said shoe, and said shock absorber insert being about the same length as the width of said upper end of said sole piece in the rear section of said sole piece.

15. The athletic shoe as claimed in claim 14, which consists of a transverse tread design at the front section of said sole piece and a longitudinal tread design at the rear section of said sole piece and said longitudinal tread lies parallel to the length of said sole piece and said transverse tread lies across to the width of said sole piece.

16. The athletic shoe as claimed in claim 14, wherein said ground engaging bottom surface has a longitudinal tread design at the rear section of said sole on a smooth continuous surface and said longitudinal tread lies parallel to the length of said sole.

17. The athletic shoe as claimed in claim 14, wherein said ground engaging bottom surface of said sole piece has a transverse tread design at the front section of said sole on a smooth continuous surface and said tread lies transverse to the width of said sole.

18. The athletic shoe as claimed in claim 17, wherein said ground engaging bottom surface has a longitudinal tread design at the rear section of said sole on said smooth continuous surface and said longitudinal tread lies parallel to the length of said sole.

* * * * *